US009101221B2

(12) United States Patent
LaPointe

(10) Patent No.: US 9,101,221 B2
(45) Date of Patent: Aug. 11, 2015

(54) FURNITURE MEMBER WITH CENTER SUPPORT LEG REST

(71) Applicant: La-Z-Boy Incorporated, Monroe, MI (US)

(72) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 50 days.

(21) Appl. No.: 13/948,429

(22) Filed: Jul. 23, 2013

(65) Prior Publication Data

US 2015/0028646 A1 Jan. 29, 2015

(51) Int. Cl.
*A47C 7/50* (2006.01)

(52) U.S. Cl.
CPC ..... *A47C 7/506* (2013.01)

(58) Field of Classification Search
CPC ..... A47C 7/506
USPC ..... 297/68, 69, 83, 84, 85 M, 423.19, 297/423.26, 423.27, 423.37
See application file for complete search history.

(56) References Cited

U.S. PATENT DOCUMENTS 246,652 A * 9/1881 Bailey ..... 297/75
252,169 A * 1/1882 Archer ..... 297/340
541,249 A * 6/1895 Price ..... 297/69
611,327 A * 9/1898 Kelly ..... 297/423.37
787,675 A * 4/1905 Kelly ..... 297/271.4
1,279,120 A * 9/1918 Kellogg ..... 607/115
2,738,593 A * 3/1956 Fox ..... 34/90
3,151,910 A * 10/1964 Larson ..... 297/344.22
3,476,495 A * 11/1969 Church ..... 297/83
3,642,320 A * 2/1972 Ward ..... 297/344.18
3,820,844 A * 6/1974 Fortnam ..... 297/423.37
4,365,836 A * 12/1982 Jackson et al. ..... 297/85 M
5,039,167 A * 8/1991 Sweet ..... 297/423.37
5,088,789 A 2/1992 LaPointe et al.
5,156,441 A 10/1992 Byersmith et al.
5,217,276 A 6/1993 LaPointe et al.
5,255,957 A * 10/1993 Opsvik et al. ..... 297/423.12
5,388,886 A 2/1995 LaPointe et al.
5,435,622 A 7/1995 Fay et al.
5,482,350 A * 1/1996 Komorowski et al. ..... 297/85 M
5,582,457 A 12/1996 Komorowski et al.
5,735,571 A * 4/1998 Colondona ..... 297/35
5,806,921 A 9/1998 LaPointe et al.
5,845,961 A 12/1998 LaPointe et al.
5,857,739 A * 1/1999 Smith ..... 297/88
5,890,765 A 4/1999 LaPointe et al.
5,954,392 A 9/1999 Liss et al.

(Continued)

*Primary Examiner* — Ryan Kwiecinski
(74) *Attorney, Agent, or Firm* — Harness, Dickey & Pierce, P.L.C.

(57) ABSTRACT

A furniture member leg rest assembly includes a leg rest mechanism connected to a furniture member base frame. A leg rest mount board is connected to the leg rest mechanism and is extensible by actuation of the leg rest mechanism away from a stowed position by movement in a direction coincident with a lateral centerline of the furniture member to a fully extended and a center position of the leg rest mount board. A pin rotatably connects the leg rest mechanism to the base frame such that the leg rest mount board when positioned in the fully extended and the center position is further manually rotatable with respect to a leg rest axis of rotation defined by the pin in at least one of a clockwise or a counterclockwise direction of rotation creating a furniture member occupant egress space.

22 Claims, 15 Drawing Sheets

(56) References Cited

U.S. PATENT DOCUMENTS

| | | | | |
|---|---|---|---|---|
| 5,975,627 | A | 11/1999 | LaPointe et al. | |
| 5,992,930 | A | 11/1999 | LaPointe et al. | |
| 5,992,931 | A | 11/1999 | LaPointe et al. | |
| 6,145,931 | A * | 11/2000 | Subotic | 297/423.2 |
| 6,209,951 | B1 * | 4/2001 | Han | 297/45 |
| 6,409,262 | B1 | 6/2002 | LaPointe | |
| 6,431,109 | B1 * | 8/2002 | Martin | 114/363 |
| 6,655,732 | B1 | 12/2003 | LaPointe | |
| 6,893,085 | B2 | 5/2005 | LaPointe et al. | |
| 6,896,323 | B2 | 5/2005 | LaPointe et al. | |
| 7,338,132 | B2 | 3/2008 | LaPointe | |
| 7,585,018 | B2 | 9/2009 | LaPointe et al. | |
| 7,967,383 | B2 | 6/2011 | LaPointe | |
| 8,132,855 | B2 | 3/2012 | Richard | |
| 8,366,188 | B2 | 2/2013 | Adams et al. | |
| 8,926,009 | B1 * | 1/2015 | LaPointe | 297/85 M |
| 2003/0173808 | A1 * | 9/2003 | Ruckstadter | 297/320 |
| 2004/0232741 | A1 * | 11/2004 | Kristen | 297/68 |
| 2009/0243348 | A1 * | 10/2009 | Toso et al. | 297/68 |
| 2011/0133527 | A1 * | 6/2011 | Taylor | 297/183.1 |
| 2012/0056453 | A1 * | 3/2012 | Andoloro | 297/195.11 |
| 2013/0169018 | A1 * | 7/2013 | Fischer | 297/423.19 |
| 2014/0084659 | A1 * | 3/2014 | Archambault et al. | 297/423.19 |

* cited by examiner

FURNITURE MEMBER WITH CENTER SUPPORT LEG REST

FIELD

The present disclosure relates to extensible and retractable leg rest assemblies for furniture members such as chairs, recliners, ottomans, couches and loveseats.

BACKGROUND

This section provides background information related to the present disclosure which is not necessarily prior art.

Furniture members such as chairs, recliners, ottomans, couches and loveseats may include a leg rest assembly that is extended either manually or by powered operation, which provides support for the legs and feet of a furniture member occupant when extended from a retracted to an extended position. Known leg rest mechanisms commonly permit the leg rest assembly to extend directly outward along a lateral centerline of the furniture member, and to retract along the same centerline. Common leg rest assemblies include a locking or latching portion that retains the leg rest assembly in the extended position until the occupant acts to retract the leg rest assembly. Common leg rest assemblies while the leg rest is in the extended position do not permit easy egress from the chair and therefore require the leg rest assembly to be retracted before the occupant can exit the furniture member.

SUMMARY

This section provides a general summary of the disclosure, and is not a comprehensive disclosure of its full scope or all of its features.

According to several aspects, a furniture member leg rest assembly includes a leg rest assembly connected to a base frame of a furniture member and extensible away from a stowed position by movement in a direction coincident with a lateral centerline of the furniture member to a fully extended and a center position of the leg rest assembly. A pin rotatably connects the leg rest assembly to the base frame such that the leg rest assembly when positioned in the fully extended and the center position is further manually rotatable with respect to a leg rest axis of rotation defined by the pin in at least one of a clockwise or a counterclockwise direction of rotation thereby creating a furniture member occupant egress space while the leg rest assembly is positioned in the fully extended position.

According to further aspects, a furniture member leg rest assembly includes a leg rest mechanism connected to a furniture member base frame. A leg rest mount board is connected to the leg rest mechanism and is extensible by actuation of the leg rest mechanism away from a stowed position by movement in a direction coincident with a lateral centerline of the furniture member to a fully extended and a center position of the leg rest mount board. A pin rotatably connects the leg rest mechanism to the base frame such that the leg rest mount board when positioned in the fully extended and the center position is further manually rotatable with respect to a leg rest axis of rotation defined by the pin in at least one of a clockwise or a counterclockwise direction of rotation creating a furniture member occupant egress space.

According to additional aspects, a furniture member leg rest assembly includes a leg rest assembly connected to a base frame of a furniture member and extensible away from a stowed position by movement in a direction coincident with a lateral centerline of the furniture member to a fully extended and a center position of the leg rest assembly. A leg rest mechanism connects the leg rest assembly to the base frame. The leg rest mechanism includes an electric motor acting when energized in a first mode to extend the leg rest assembly away from the stowed position toward the fully extended position, and when energized in a second mode acting to return the leg rest assembly from the fully extended to the stowed position. A detent assembly of the leg rest mechanism has a central detent position releasably retaining the leg rest assembly at the fully extended and the center position. A pin rotatably connects the leg rest assembly to the leg rest mechanism such that the leg rest assembly when positioned in the fully extended and the center position is further manually rotatable with respect to a leg rest axis of rotation defined by the pin in at least one of a clockwise or a counterclockwise direction of rotation thereby creating a furniture member occupant egress space while the leg rest assembly is positioned in the fully extended position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
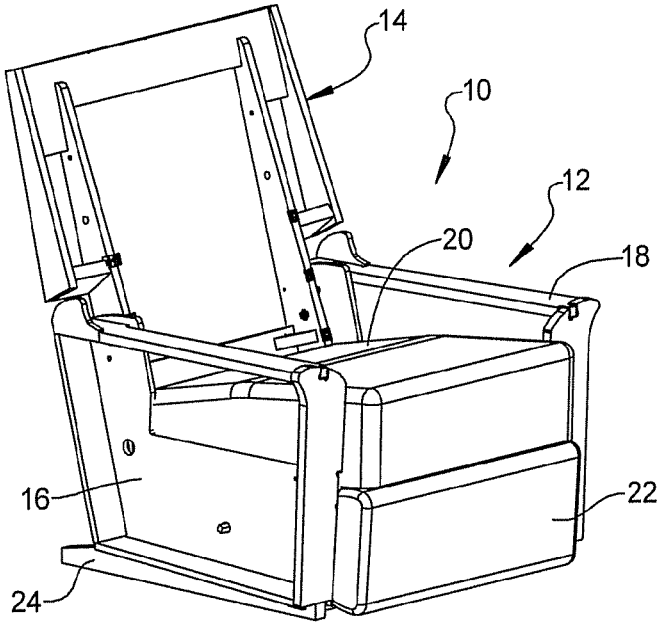
FIG. 1 is a front right perspective view of a furniture member having a center support leg rest assembly of the present disclosure.

Referring to FIG. 1, a furniture member 10, which is depicted as a rocking reclining chair, includes a base frame 12 and a seat back 14 which is rotatable with respect to base frame 12. Furniture member 10 is not limited by the reclining chair design shown, and can be any type of furniture member also including a couch, a chaise, a loveseat, and the like. Base frame 12 includes each of a first arm member 16 positioned on a right hand side of an occupant seated in furniture member 10, and a second arm member 18 positioned on a left hand side of the occupant. A seat member 20 is positioned between the first and second arm members 16, 18. A leg rest assembly 22 is positioned forward of the seat member 20 and is shown in its fully retracted position. The base frame 12 and seat back 14 are together rotatably supported on a frame 24. For clarity, the base frame 12 and seat back 14 are shown without upholstery which would normally be present, and the seat member 20 and leg rest assembly 22 are shown with upholstery.

Referring to FIG. 2 and again to FIG. 1, with the seat back 14 in the fully upright position shown, the base frame 12 can rotate in each of a rearward rotation direction "A" and a forward rotation direction "B". The frame 24 is designed to directly contact a floor surface 26 which is nominally planar and support the furniture member 10 on the floor surface 26.

Figure 2:
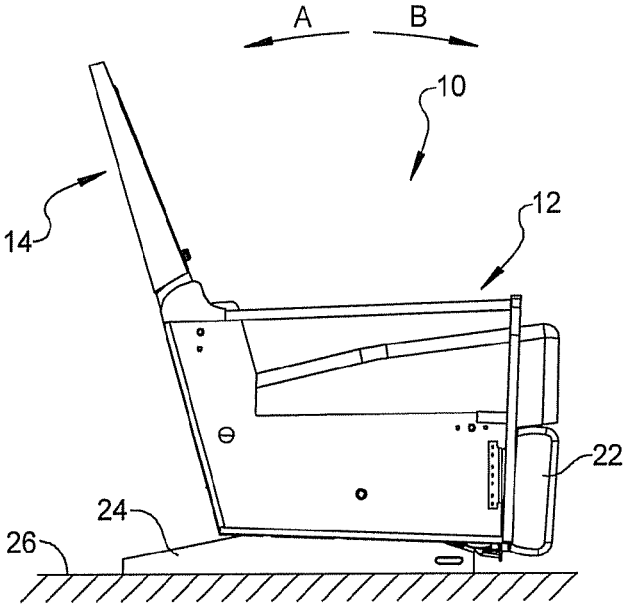
FIG. 2 is a right side elevational view of the furniture member of FIG. 1.

Referring to FIG. 3 and again to FIGS. 1 and 2, the leg rest assembly 22 is extensible from the stowed position shown in FIGS. 1 and 2 to a fully extended position by operation of a leg rest mechanism 28. As the leg rest assembly 22 extends, the seat back 14 and base frame 12 together rotate in a seat member rotation direction "C" with respect to frame 24. Leg rest assembly 22 extends in a leg rest extension direction "D" by operation of the leg rest mechanism 28 away from a frame panel 30 of base frame 12. In its fully extended position, the leg rest assembly 22 is positioned forward of a forward seat face 32 of the seat member 20. Operation of the leg rest mechanism 28 to extend the leg rest assembly 22 rotates the base frame 12 rearwardly in the seat member rotation direction "C", which also elevates a forward edge 33 of the base frame 12 with respect to a forward frame member 34 of frame 24.

Referring to FIG. 4 and again to FIG. 3, to provide support for the legs of the occupant of furniture member 10 as well as the weight of the leg rest assembly 22 in its fully extended position, as the leg rest mechanism 28 actuates, a support foot 36 extends downwardly in a support foot extension direction "E" to make contact with the forward frame member 34 shown and described with reference to FIG. 3. The support foot 36 extends by operation of a support foot extension shaft 38. The support foot 36 in contact with the forward frame member 34 thereafter prevents rotation of base frame 12 in the forward rotation direction "B" while the leg rest assembly 22 is in its extended position. According to several aspects, support foot 36 is a polymeric material, such as a molded polyamide material, to reduce its weight while providing rigidity.

Figure 3:
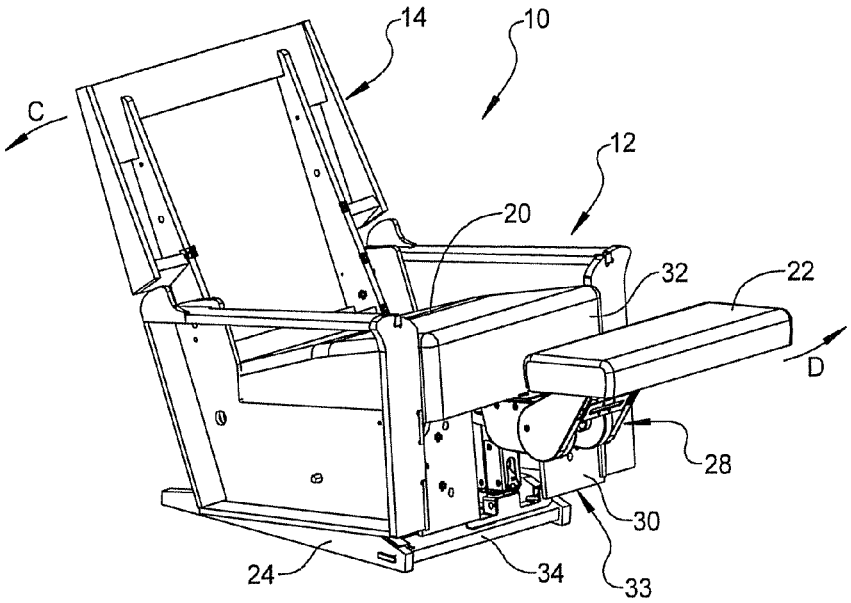
FIG. 3 is a front right perspective view similar to FIG. 1 further showing the leg rest assembly in a fully extended center position.
Figure 4:
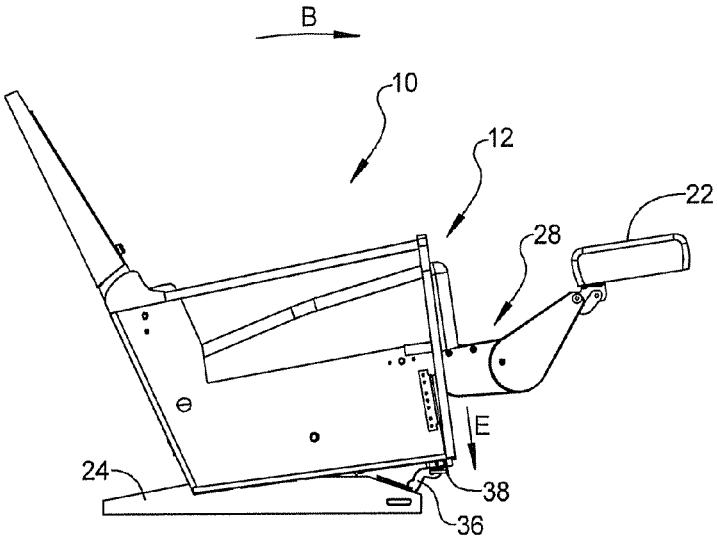
FIG. 4 is a right side elevational view of the furniture member of FIG. 2 with the leg rest assembly in the fully extended center position.

Referring to FIG. 5 and again to FIGS. 3-4, the leg rest assembly 22 is shown in the fully extended, center position wherein leg rest assembly 22 is substantially centered with respect to a lateral centerline 40 of furniture member 10. The leg rest assembly 22 in this position therefore provides equal support for the right and left legs of the occupant of furniture member 10 when centered with respect to lateral centerline 40.

Figure 5:
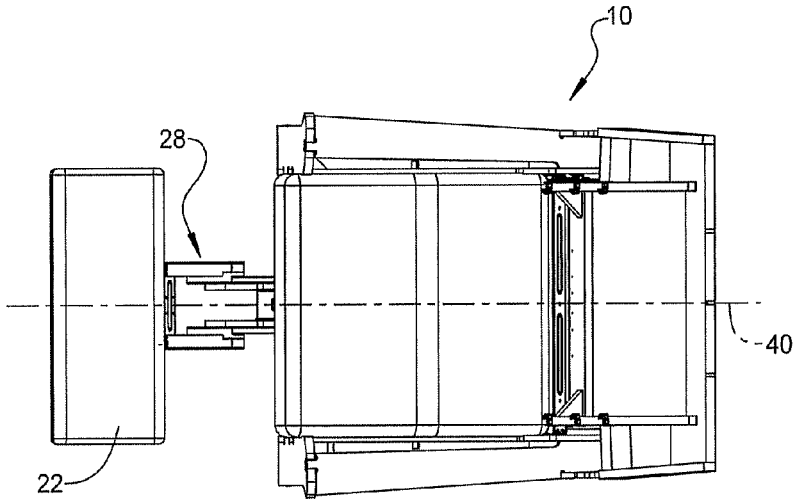
FIG. 5 is a top plan view of the furniture member of FIG. 3.

Referring to FIG. 6 and again to FIGS. 3-5, after the leg rest assembly 22 reaches the fully extended position, further operation of seat back 14 by rotation in a seat back reclining direction "F", as well as additional rotation of base frame 12 in the rearward rotation "A", causes the support foot 36 to be repositioned freely above and therefore displace away from the forward frame member 34. In order to provide the support for the weight of the occupant's legs on leg rest assembly 22 when the support foot 36 is no longer in contact with forward frame member 34, the rearward rotation of seat back 14 in the seat back reclining direction "F" causes downward extension of both a first extension bracket 44 and a second extension bracket 45 from locations positioned proximate to the forward lower corners of each of the first and second arm members 16, 18. As each of the first and second extension brackets 44, 45 extend downwardly, a first reinforcing pad 46 of each of the first and second extension brackets 44, 45, for example first reinforcing pad 46, makes direct contact with a pad surface 48 of the first reinforcing pad 46 which is fixed to a first frame angular surface 50 of frame 24. The second extension bracket 45 similarly contacts a second reinforcing pad 52 which is fixed to a second frame angular surface 54 on an opposite side of the frame 24 with respect to first reinforcing pad 46. The first and second extension brackets 44, 45 thereafter provide non-rotational support for both base frame 12 and seat back 14 with the leg rest assembly 22 in the fully extended position and the seat back 14 in the fully reclined position shown.

The first and second extension brackets 44, 45 are components of and actuated by mirror image first and second mechanism subassemblies 186, 187, with first mechanism subassembly 186 shown and described in reference to FIG. 22. According to several aspects, first and second mechanism subassemblies 186, 187 are actuated independently of the operation of leg rest mechanism 28, for example by an independently provided actuation motor (not shown) which can control reclining operation of the seat back 14 in the seat back reclining direction "F" to its fully reclined position. Seat back motion in seat back reclining direction "F" can therefore occur with the leg rest assembly 22 stowed, partially extended, or fully extended.

Opposite operation and rotation of seat back 14 with respect to the seat back reclining direction "F" returns seat back 14 toward its fully upright position shown in FIG. 1. During this return rotation, each of the first and second extension brackets 44, 45 retract upwardly into their respective first or second arm member 16, 18. This will initially return the support foot 36 into direct contact with forward frame member 34 until the leg rest assembly 22 is further rotated back toward its stowed position. Rotation of the leg rest assembly 22 away from the fully extended position and back toward its stowed position will upwardly retract the support foot 36, thereafter allowing free rotation of base frame 12 with respect to frame 24.

Figure 6:
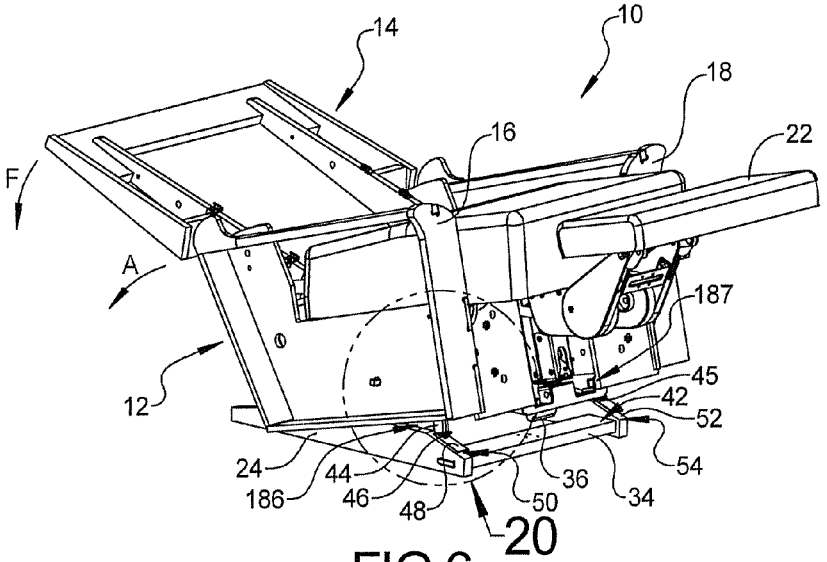
FIG. 6 is a front right perspective view similar to FIG. 3 further showing the seat back member in a fully reclined position.
Figure 7:
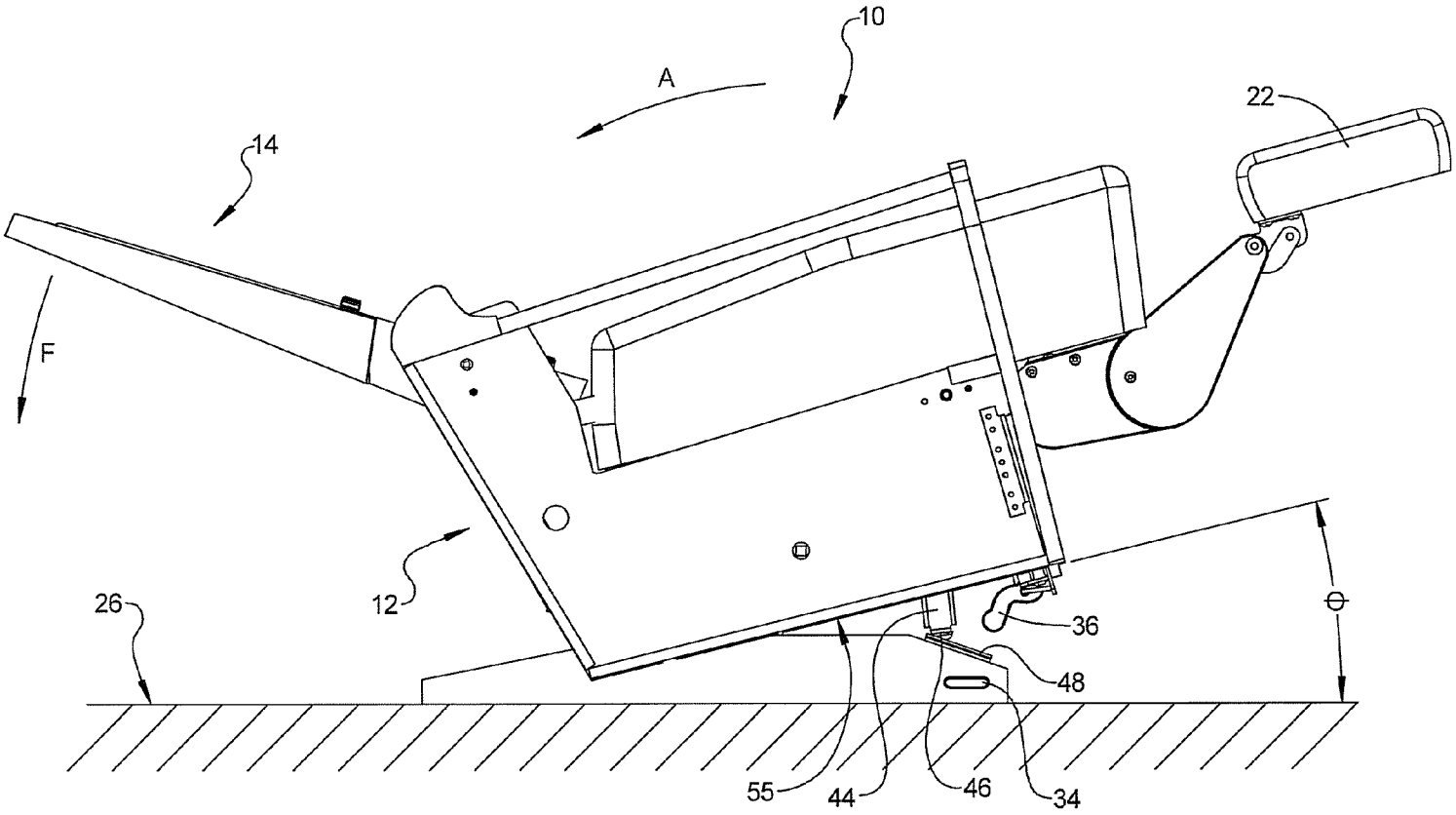
FIG. 7 is a right side elevational view of the furniture member of FIG. 6.

Referring to FIG. 7 and again to FIG. 6, the direct contact between first reinforcing pad 46 of the first extension bracket 44 with pad surface 48 is clearly defined during the time when the support foot 36 is freely spaced from the forward frame member 34. A maximum rotation angle θ is defined between a base frame bottom edge 55 and the floor surface 26 when the base frame 12 is rotated to its furthest rearward position in the rearward rotation direction "A" and seat back 14 is rotated to its fully reclined position. The extension of the first and second extension brackets 44, 45 (only first extension bracket 44 is visible in this view) maintain this rearward rotated position of furniture member 10.

Referring to FIG. 8 and again to FIG. 3, the leg rest assembly 22 can also be rotated away from the extended center position in either a counterclockwise or a clockwise rotation direction by the occupant of furniture member 10 manually applying a force to the leg rest assembly. For example, by manually pushing against a first leg rest face 56 of leg rest assembly 22, the leg rest assembly 22 can be rotated in a counterclockwise direction of rotation "G" while maintaining the fully extended position of leg rest assembly 22. This rotation is provided through leg rest mechanism 28 and does not rotate either base frame 12 or seat back 14.

Figure 8:
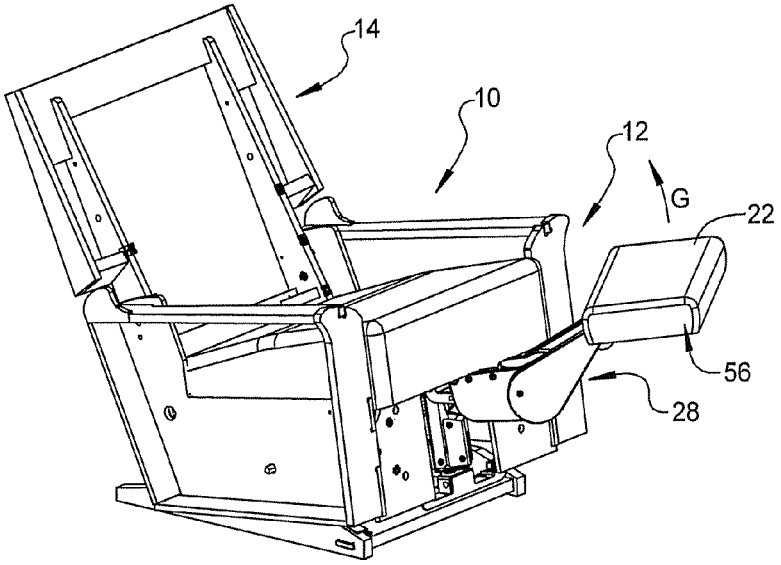
FIG. 8 is a right side elevational view of the furniture member of FIG. 2 with the leg rest assembly in a fully extended counterclockwise rotated position.

Referring to FIG. 9 and again to FIG. 8, as the leg rest assembly 22 is rotated in the counterclockwise direction of rotation "G", the contact position between support foot 36 and frame 24 is maintained, thereby continuing to provide support for the weight of leg rest assembly 22 in its fully extended position. The contact between support foot 36 and frame 24 is maintained throughout the side-to-side rotation range of leg rest assembly 22.

Figure 9:
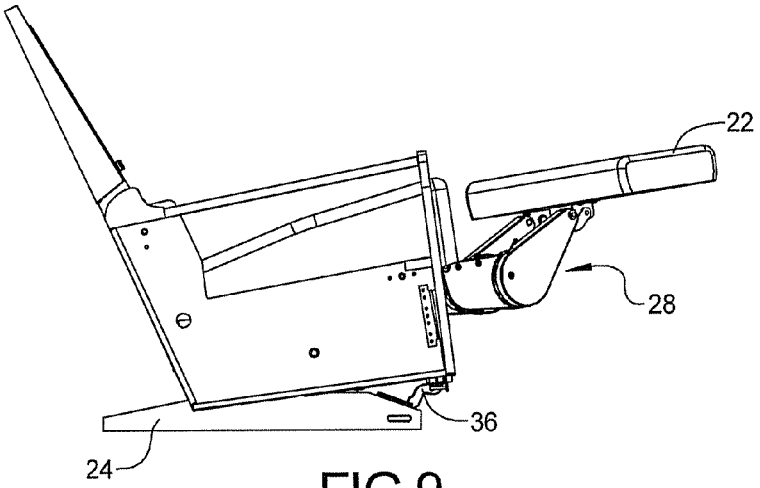
FIG. 9 is a right side elevational view of the furniture member of FIG. 8.

Referring to FIG. 10 and again to FIGS. 8-9, as the occupant presses one of their legs against the first leg rest face 56, the leg rest assembly 22 rotates with respect to a leg rest axis of rotation 58. Leg rest axis of rotation 58 defines a rotational axis of the leg rest assembly for rotation of the leg rest mechanism 28 with respect to base frame 12. Leg rest assembly 22 will rotate in the counterclockwise direction of rotation "G" (as viewed from above furniture member 10) for a leg rest counterclockwise angle of rotation α of at least 30 degrees, and according to several aspects leg rest assembly will rotate for approximately 45 degrees at its fully rotated position. At its counterclockwise fully rotated position, a first leg rest corner 60 is spaced away from a first arm member 16 forward corner 62, thereby defining an egress space 64 for the occupant of the furniture member 10 to stand and exit furniture member 10 while the leg rest assembly 22 is maintained in the fully extended position.

Figure 10:
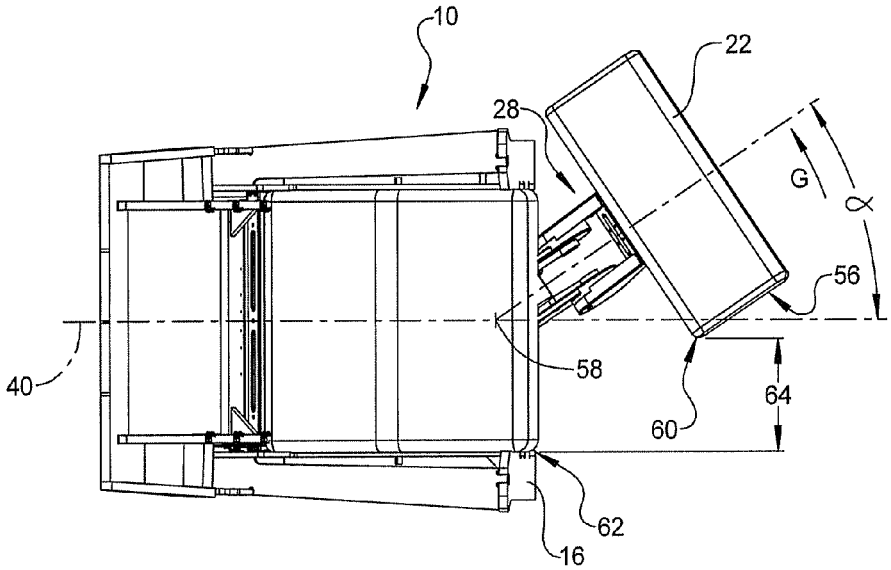
FIG. 10 is a top plan view of the furniture member of FIG. 8.

Referring to FIG. 11 and again to FIG. 10, by oppositely manually pressing against a second leg rest face 70 of leg rest assembly 22, the occupant of furniture member 10 can manually rotate leg rest assembly 22 in a clockwise direction of rotation "H" for a leg rest clockwise angle of rotation β. According to several embodiments, clockwise angle of rotation β is substantially equal to leg rest counterclockwise angle of rotation α and is therefore at least 30 degrees and according to several aspects is approximately 45 degrees of clockwise rotation. Between a second leg rest corner 66 and a second arm member 18 forward corner 68 the clockwise rotation of leg rest assembly 22 creates an egress space 72, which is substantially equal in size to egress space 64. Egress space 72 allows the occupant of furniture member 10 to stand and exit furniture member 10 between second leg rest corner 66 and the second arm member 18 forward corner 68 while the leg rest assembly 22 is maintained in the fully extended position.

Referring to FIG. 12 and again to FIGS. 1-3, the leg rest mechanism 28 is shown in greater detail. A first panel bracket 74 and an oppositely positioned second panel bracket 76 are fixedly connected to first and second support tubes 78, 80, and connect the first and second support tubes 78, 80 to the first and second arm members 16, 18. The frame panels 30 which are connected to the first and second support tubes 78, 80 provide support for upholstery. The first and second support tubes 78, 80 provide rigidity for the leg rest mechanism 28 and also act to support the weight of the leg rest mechanism 28 when extended. According to several aspects, the first and second support tubes 78, 80 are rectangular tubing which are formed in a U-shape, providing clearance peripherally about the elements of leg rest mechanism 28 as well as rigidity. A mechanism housing 82, created from a metal material such as steel, is supported by a structure connected to each of the first and second support tubes 78, 80. The mechanism housing 82 is positioned in a vertical orientation having the leg rest axis of rotation 58 extending centrally therethrough.

Figure 16:
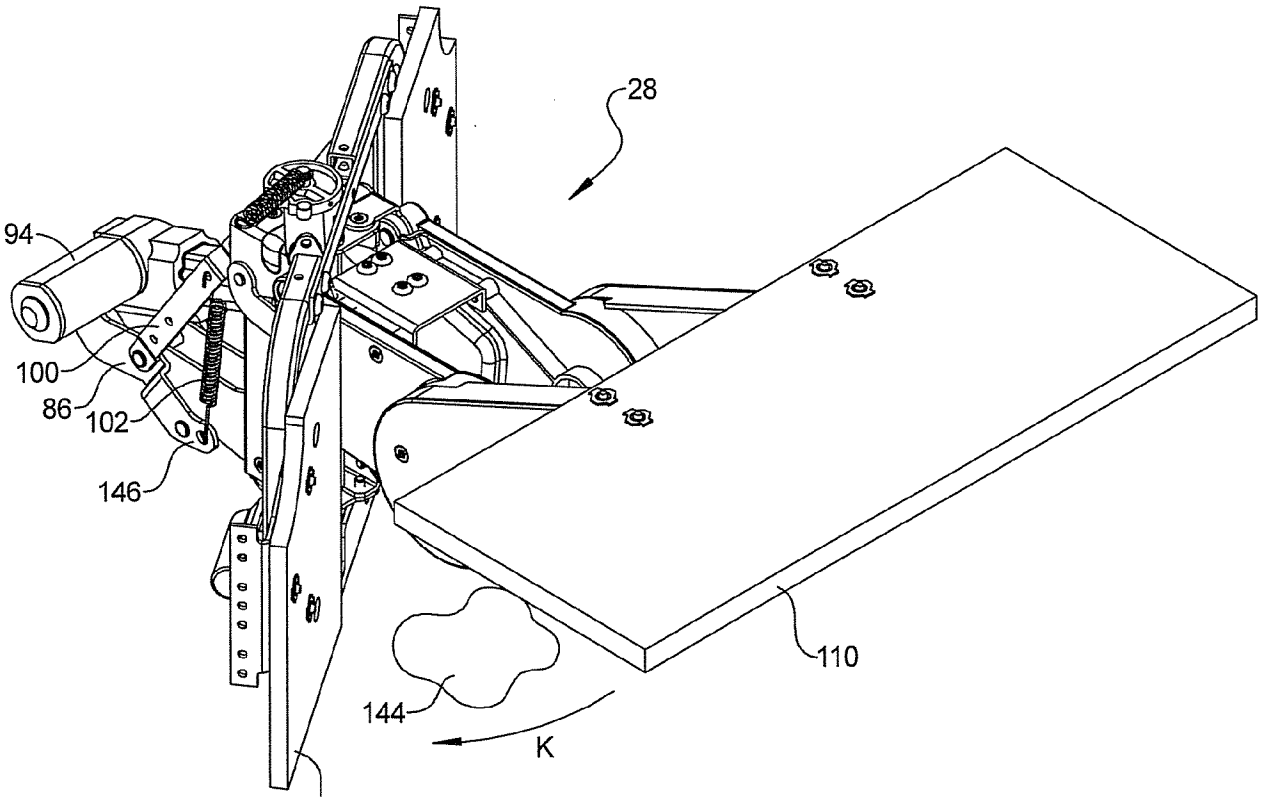
FIG. 16 is a right side perspective view looking rearward of the leg rest mechanism of FIG. 15.

A first motor support link 84 and a second motor support link 86 are both rotatably connected to the structure of mechanism housing 82. A support clevis 88, which is connected to a drive housing 90, is rotatably connected to each of the first and second motor support links 84, 86 by a support pin 92. The drive housing 90 is therefore rotatably supported to the first and second motor support links 84, 86. An electric motor 94, such as a DC motor, is mounted to the drive housing 90 and acts, when energized, to extend or retract a tube positioned within a drive tube support housing 96 which is oppositely fixedly connected to the drive housing 90 with respect to the support clevis 88. The electric motor 94 acts when energized in a first mode (defined as an extend command provided by the occupant via for example a motor control switch or hand wand, not shown) to extend the leg rest assembly 22 away from the stowed position toward the fully extended position, and acts when energized in a second mode (defined as a retract command given by the occupant) to return the leg rest assembly 22 from the fully extended to the stowed position. The first mode causes rotation of electric motor 94 in a first rotational direction and the second mode causes rotation in a second, opposite rotational direction. Alternately, the electric motor 94 can operate in a single rotational direction, and a gear or transmission/clutch system of the drive housing 90 can be oppositely actuated to provide the extension and retraction motions of leg rest assembly 22. First and second motor support links 84, 86 also permit independent displacement of the motor and drive housing 94, 90 with respect to the mechanism housing 82 if the leg rest assembly 22 encounters an object during retraction, which will be described in greater detail in reference to FIG. 16.

Also connected to each of the first and second motor support links 84, 86 are a first motor brace link 98 and a second motor brace link 100. In order to return the configuration of the drive housing 90 and motor 94 to the nominal position shown, a first motor biasing member 102 is connected to the second motor brace link 100 as well as to the second motor support link 86. In addition, a second motor biasing member 103 (only partially shown in this view) is connected to each of the first motor brace link 98 and first motor support link 84. The first and second motor biasing members 102, 103 can be provided, for example, in the configuration of a tension spring.

Also rotatably linked to the mechanism housing 82 are each of a first clamshell housing 104 and a second clamshell housing 106 which are freely displaceable through a panel aperture 108 created in frame panel 30. A linkage assembly similar to a pantograph linkage assembly is housed within the first and second clamshell housings 104, 106 to provide connection between mechanism housing 82 and a leg rest mount board 110 (the leg rest member or assembly 22 shown without upholstery). In the fully retracted position of the leg rest assembly 22, the leg rest mount board 110 is substantially parallel to and can be in direct contact with frame panel 30. During operation of motor 94, the leg rest mount board 110 is rotated freely away from frame panel 30 to achieve the leg rest extended position shown and described in reference to FIG. 3.

Because the leg rest mount board 110 can rotate with respect to leg rest axis of rotation 58 when the leg rest assembly 22 is in its fully extended position, a detent assembly 112 biased by a detent assembly spring 114 is provided which normally biases the leg rest assembly to the fully extended center position. Detent assembly 112 is further capable of retaining leg rest assembly 22 at the full extent of its rotation in either the clockwise or counterclockwise directions shown and described with reference to FIGS. 10 and 11. The detent assembly 112 is aligned using a detent alignment pin 116 rotatably supported by the mechanism housing 82. Detent alignment pin 116 also establishes the leg rest axis of rotation 58. In the fully retracted position shown for leg rest mechanism 28, all of the components of the drive assembly, including the motor 94 and first and second clamshell housings 104, 106, are positioned rearward of the frame panel 30, which therefore positions the leg rest mechanism 28 substantially entirely within the base frame 12.

Figure 12:
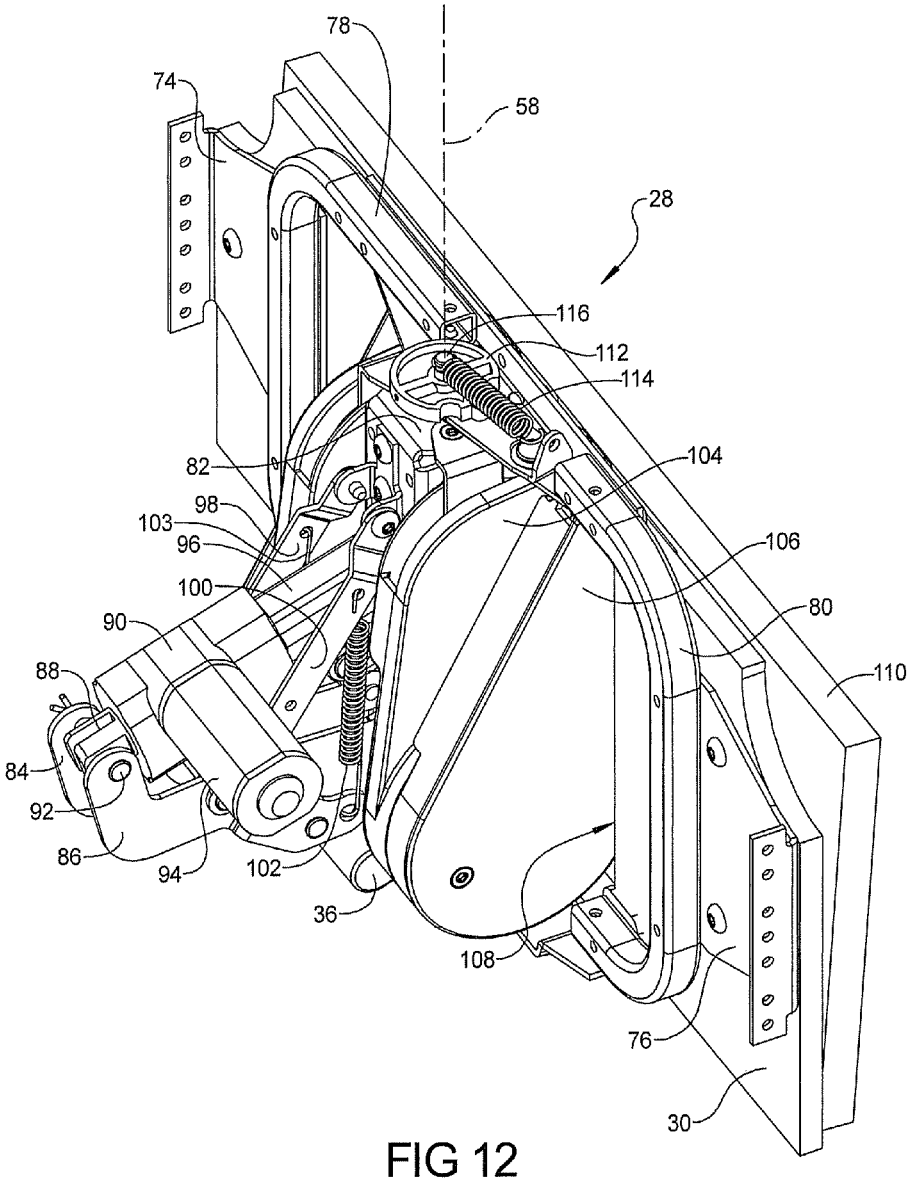
FIG. 12 is a right side perspective view looking forward of a leg rest mechanism of the present disclosure.

Referring to FIG. 13 and again to FIG. 12, positioned in opposed relationship with respect to the first and second clamshell housings 104, 106 and with respect to the leg rest axis of rotation 58 are a third and a fourth clamshell housing 118, 120. The first, second, third, and fourth clamshell housings 104, 106, 118, 120 are actuated by operation of the motor 94 as previously described which extends a leg rest drive tube 122 from the drive tube support housing 96. The leg rest drive tube 122 is coupled to an engagement plate 124 which in turn is coupled to each of the second clamshell housing 106 and third clamshell housing 118. Extension of the leg rest drive tube 122 causes rotation of the engagement plate 124 and thereby extension of the first, second, third, and fourth clamshell housings 104, 106, 118, 120. Operation of the motor 94 also causes a downward extension of a support foot extension shaft 126 which is also coaxially aligned with respect to the leg rest axis of rotation 58. The support foot extension shaft 126 extends downwardly in a support foot extension direction "J" and is directly connected to the support foot 36. It is further noted that the support foot extension shaft 126 is coaxially aligned with the detent alignment pin 116 which are both coaxially aligned with respect to the leg rest axis of rotation 58 and further provide rotational support for leg rest assembly 22.

Figure 13:
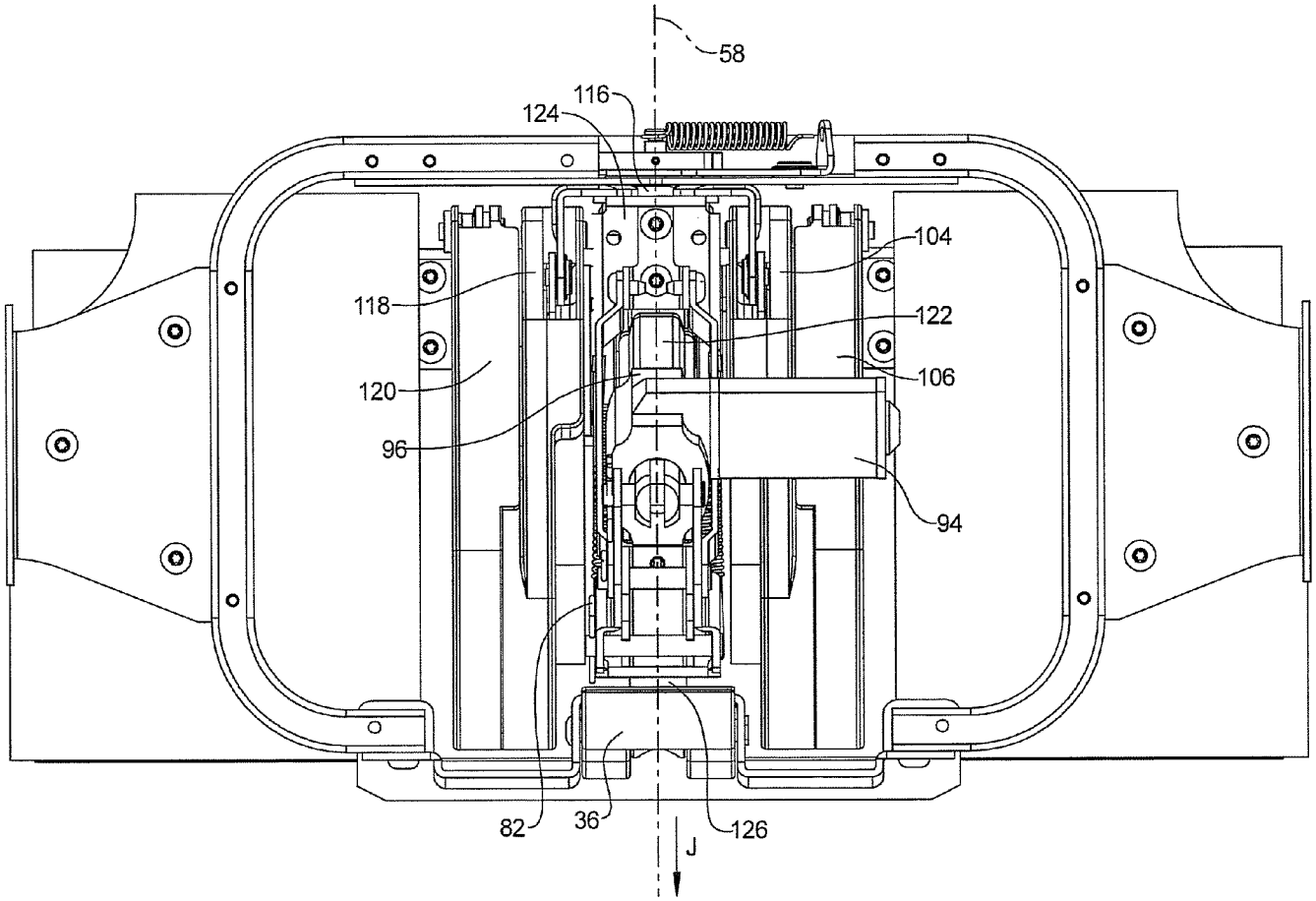
FIG. 13 is an end elevational view of the leg rest mechanism of FIG. 12.

Referring to FIG. 14 and again to FIGS. 12-13, a first connecting bracket 128 rigidly connects the engagement plate 124 to the mechanism housing 82. Similarly, a second connecting bracket 129 also rotatably connects the engagement plate 124 to the mechanism housing 82. The first and second connecting brackets 128, 129 rotate together with engagement plate 124 during clockwise and counterclockwise rotation of leg rest mechanism 28. The first and second connecting brackets 128, 129 together with engagement plate 124 are also connected to the first clamshell housing 104 and the third clamshell housing 118. The second clamshell housing 106 is connected to the leg rest mount board 110 using a first mounting bracket 130. Similarly, the fourth clamshell housing 120 is connected to the leg rest mount board 110 using a second mounting bracket 132.

Figure 14:
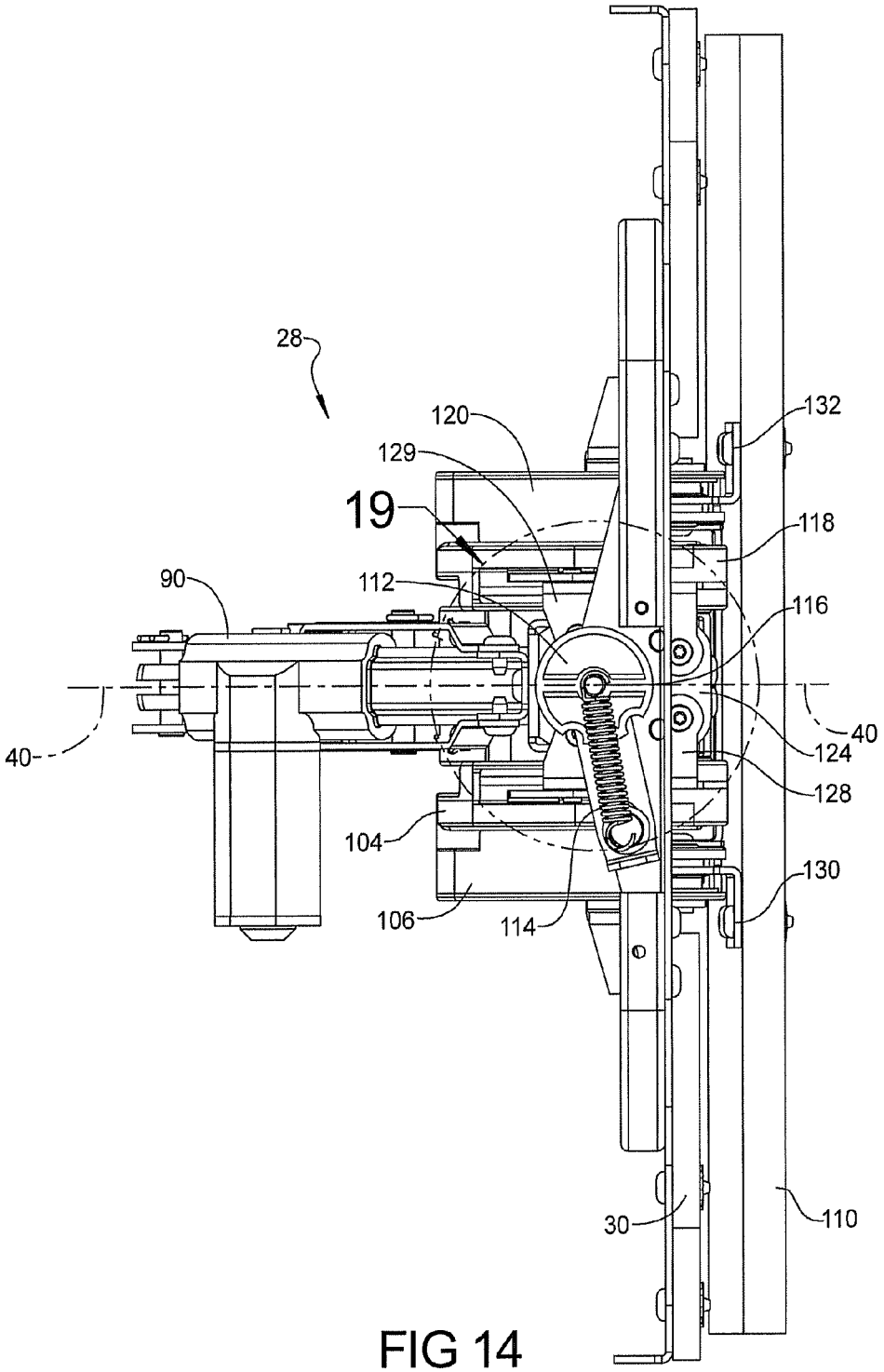
FIG. 14 is a top plan view of the leg rest mechanism of FIG. 12.
Figure 15:
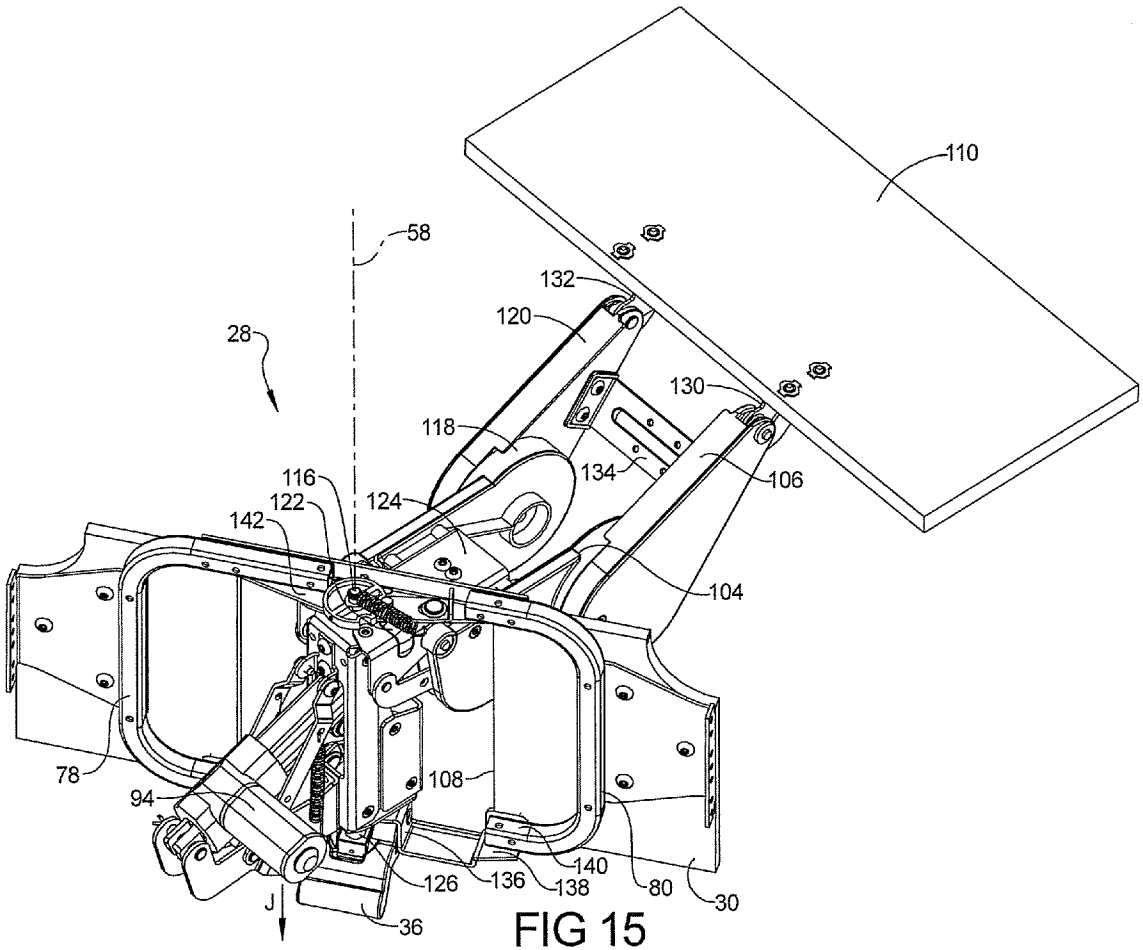
FIG. 15 is a right side perspective view looking forward of the leg rest mechanism of FIG. 12, further showing the leg rest member in the fully extended clockwise rotated position.

Referring to FIG. 15 and again to FIGS. 12-14, the leg rest mount board 110 is shown in its fully extended and clockwise rotated position. Extension of the leg rest drive tube 122 by operation of motor 94 directly rotates the engagement plate 124 to which is rotatably connected the first clamshell housing 104 and third clamshell housing 118. First and second extension links are individually connected to the engagement plate 124 and to individual linkage assemblies which act to extend the leg rest mount board 110. As previously noted, extension of the leg rest drive tube 122 during operation of motor 94 is also linked to support foot extension shaft 126 which rotates/extends the support foot 36 in the support foot extension direction "J", providing additional support for the leg rest mechanism 28 in the fully extended position. As clearly visible in FIG. 15, the panel aperture 108 created in frame panel 30 provides full clearance for rotation of the leg rest assembly to reach the full clockwise and counterclockwise rotated positions with respect to leg rest axis of rotation 58.

A U-shaped structural housing portion 136 is provided which normally receives support foot 36 in its stowed position. The U-shaped structural housing portion 136 extends outwardly into a lower flange 138 which provides a fixing location for lower ends 140 of the first and second support tubes 78, 80 (only the lower end 140 of second support tube 80 is visible in this view). An upper flange 142 provides fixing locations for upper ends of the first and second support tubes 78, 80 and well as rotational support for the detent alignment pin 116.

Referring to FIG. 16 and again to FIGS. 12-15, with the leg rest mount board 110 of the leg rest assembly in the fully extended position, the motor 94 can be operated in a reverse direction to retract the leg rest mount board 110 in a leg rest retraction direction "K". During this retraction motion, if an object 144 is encountered by the leg rest mount board 110, further powered retraction of the leg rest mechanism 28 will continue by permitting the motor 94 to rotate upwardly, thereby extending the first and second motor biasing members 102, 103 (only first motor biasing member 102 is clearly visible in this view). Once the object 144 is cleared from below leg rest mount board 110, the leg rest mount board 110 can continue its retraction motion in the leg rest retraction direction "K" using the biasing force provided by the first and second motor biasing members 102, 103. It is noted that the biasing members are connected to link free ends, such as link free end 146 of second motor support link 86 as well as to second motor rotation link 100. The leg rest mount board 110 will also self-center during the retraction motion if contact is made between the leg rest mount board 110 and the frame panel 30.

Referring to FIG. 17 and again to FIGS. 12-15, prior to extension of the leg rest assembly (not shown in this view for clarity), the leg rest drive tube 122 is in a fully withdrawn position within drive tube support housing 96. Thereafter, when motor 94 is actuated the drive force of motor 94 acting through drive housing 90 will extend leg rest drive tube 122 outwardly from drive tube support housing 96 in an extending direction "L". Leg rest drive tube 122 is coupled using a rotatable fastener 148 to a clevis 150 which is fastened to engagement plate 124 (not shown in this view for clarity). Extension of leg rest drive tube 122 outwardly from drive tube support housing 96 in the extending direction "L" acts to rotate engagement plate 124 and extend leg rest assembly 22.

Figure 17:
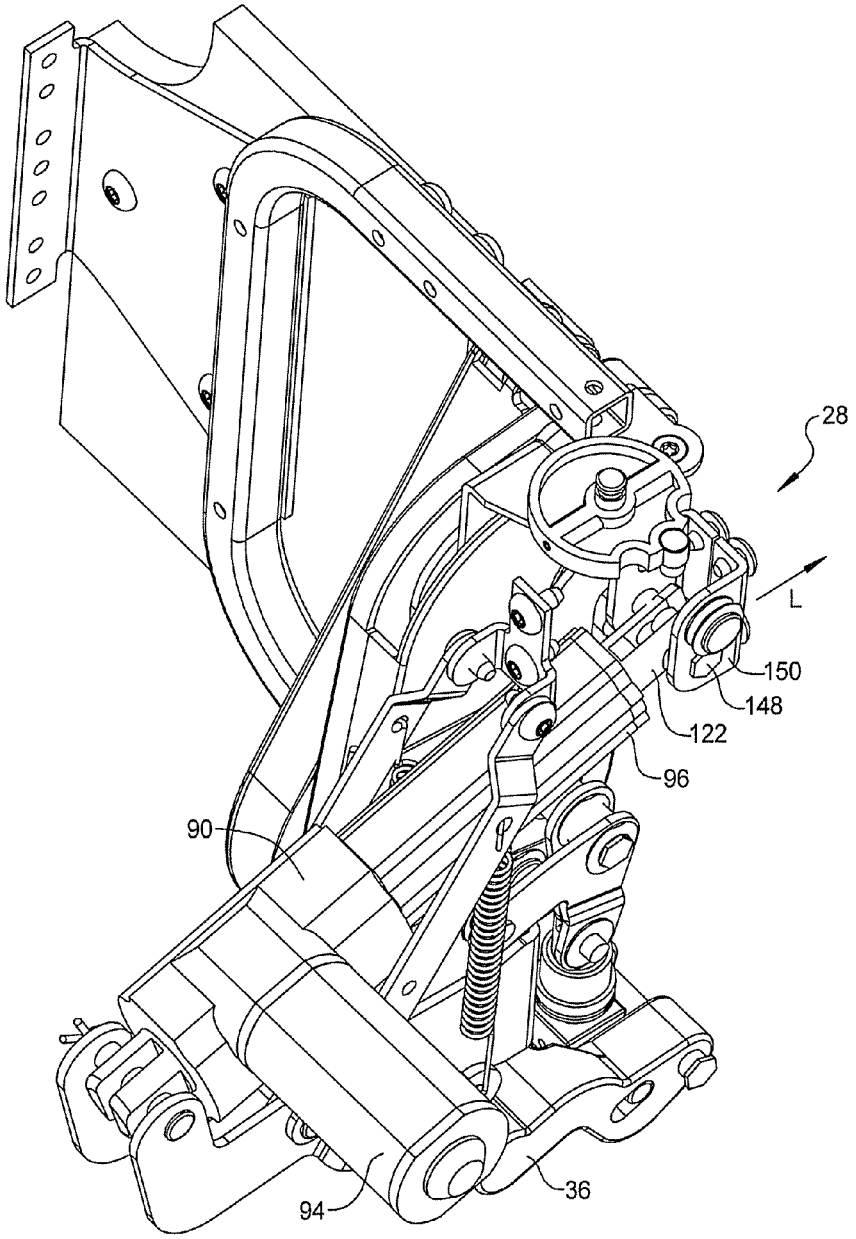
FIG. 17 is a right side perspective view looking forward of a portion of the leg rest mechanism of FIG. 15, with the leg rest member in the fully retracted position.
Figure 18:
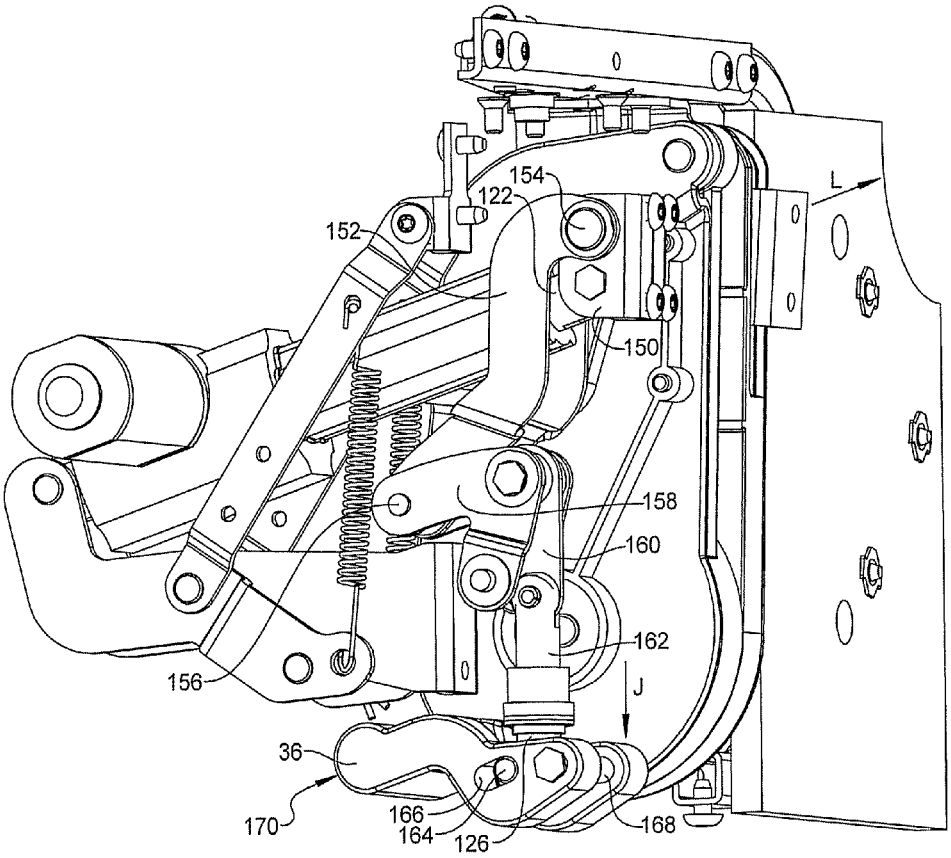
FIG. 18 is a right side perspective view looking rearward of the portion of the leg rest mechanism of FIG. 17.

Referring to FIG. 18 and again to FIG. 17, extension of leg rest drive tube 122 outwardly from drive tube support housing 96 in the extending direction "L" also acts to downwardly displace support foot extension shaft 126 and to thereby displace support foot 36 in the support foot extension direction "J" as follows. An "S" shaped link 152 is rotatably connected by a pin 154 to the clevis 150 and at an opposite end by a pin 156 to a "V" shaped link 158. The "V" shaped link 158 is in turn rotatably connected to a displacement link 160 which is coupled to an upper end 162 of the support foot extension shaft 126. As leg rest drive tube 122 extends outwardly from drive tube support housing 96 in the extending direction "L", the displacement link 160 and support foot extension shaft 126 are forced downward. The support foot extension shaft 126 is connected to a pin 164 which is positioned in an elongated slot 166 created in the support foot 36. The support foot 36 is also rotatably connected using a rotation pin 168. Downward motion of the support foot extension shaft 126 causes support foot 36 to rotate with respect to rotation pin 168, which drives a free end 170 of support foot 36 downward in the support foot extension direction "J" until the pin 164 contacts an opposite end of elongated slot 166, stopping further rotation of support foot 36.

Figure 11:
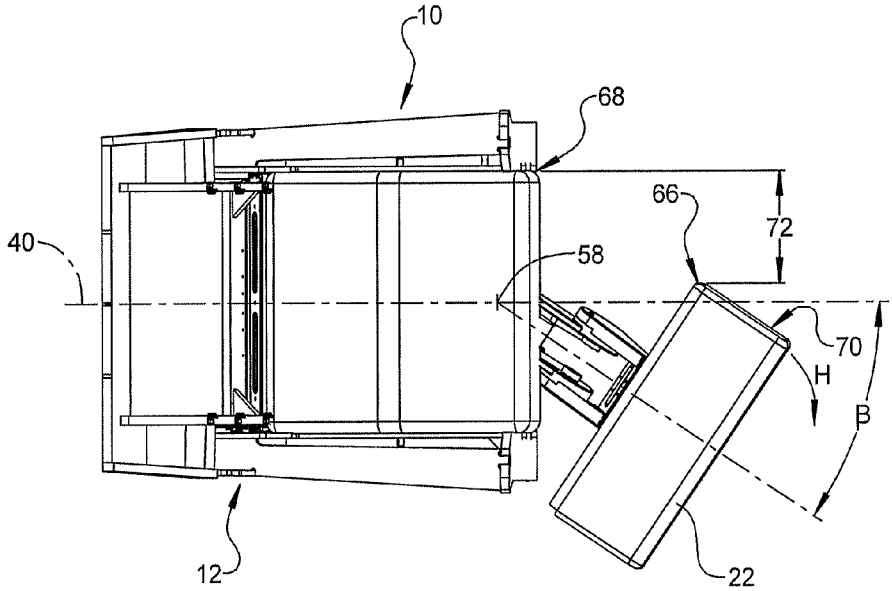
FIG. 11 is a top plan view of the furniture member of FIG. 2 with the leg rest assembly in a fully extended clockwise rotated position.
Figure 19:
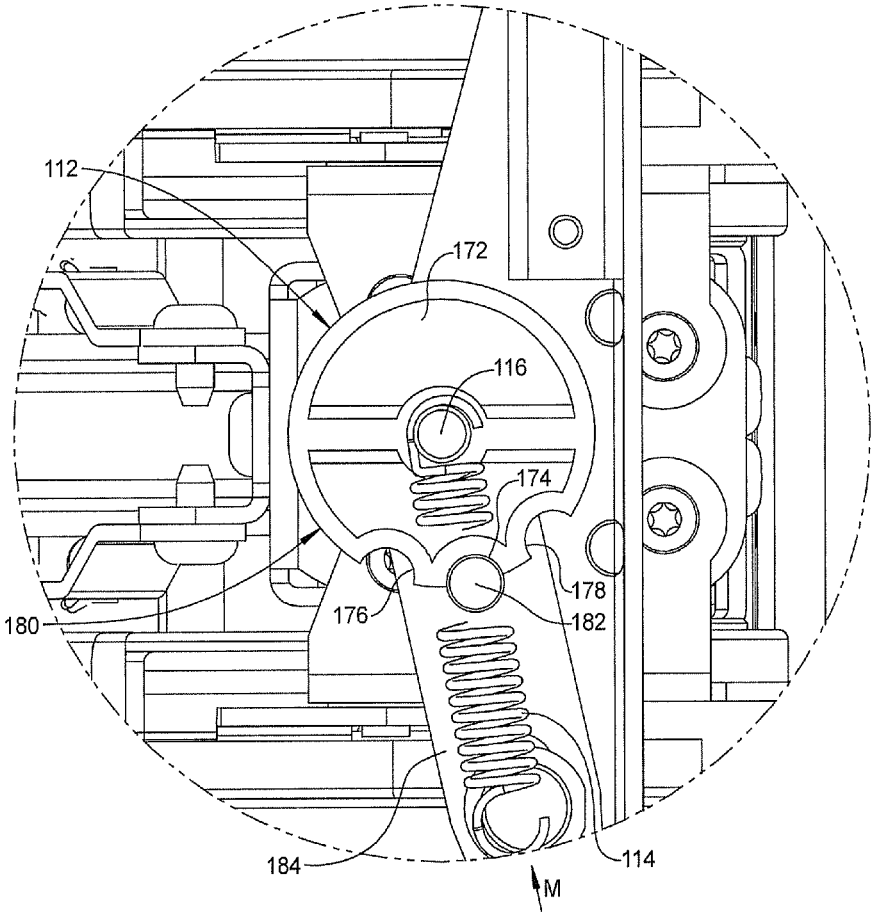
FIG. 19 is a top plan view of area 19 of FIG. 14.

Referring to FIG. 19 and again to FIGS. 5, 10, 11, 14 and 16, the detent assembly 112 includes a polymeric disc 172 having 3 semi-circular slots which define individual detent positions for retention of the leg rest assembly 22 in any one of the fully extended center position (shown in FIG. 5), the fully extended counterclockwise rotated position (shown in FIG. 10) or the fully extended clockwise rotated position (shown in FIG. 11). The disc 172 therefore includes a first slot 174, a second slot 176 and a third slot 178 created on an outward facing perimeter 180. A detent pin 182 is fixed to a moveable link 184 and biased in a biasing direction "M" by the detent assembly spring 114 such that the detent pin seeks to be retained in one of the first, second or third slots 174, 176, 178. The detent pin 182 is shown engaged in first slot 174 which defines the detent position for the fully extended center position of leg rest assembly 22. The detent pin 182 will be positioned in second slot 176 to define the detent position for the fully extended counterclockwise rotated position of leg rest assembly 22. The detent pin 182 will be positioned in third slot 178 (shown in FIG. 16) to define the detent position for the fully extended clockwise rotated position of leg rest assembly 22.

Figure 20:
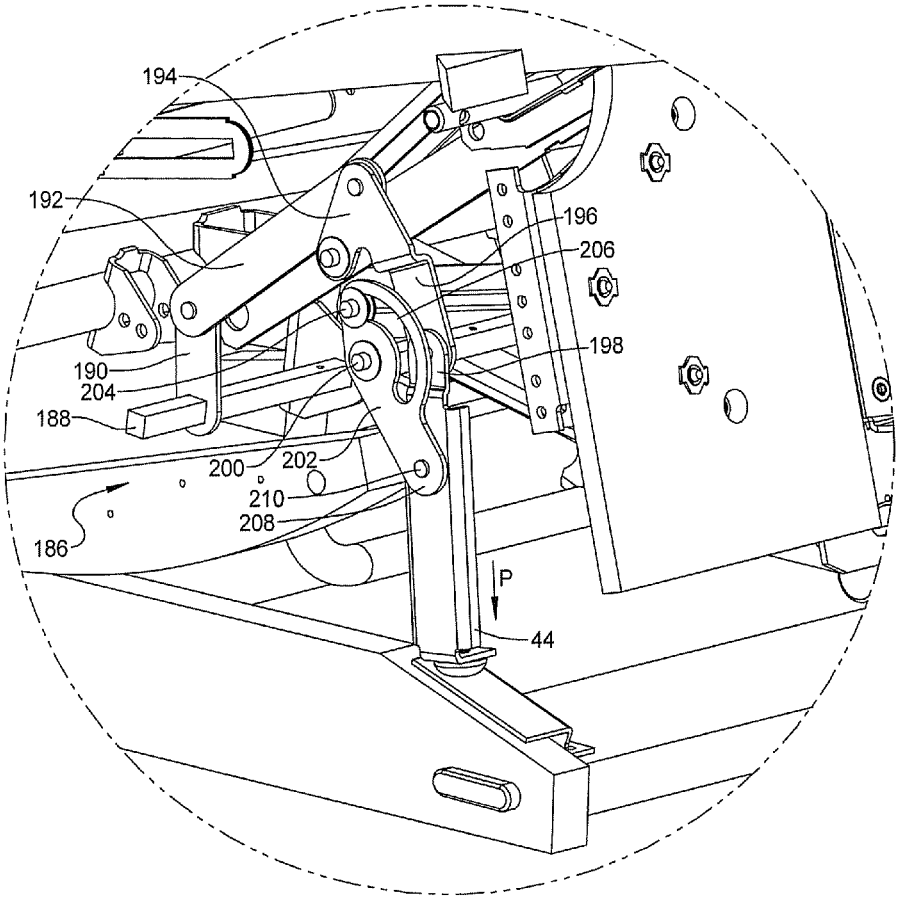
FIG. 20 is a front right perspective view of area 20 of FIG. 6, with the right armrest member removed for clarity.

Referring to FIG. 20 and again to FIG. 6, with the right or first arm member 16 removed for clarity, a first of two mirror image mechanism subassemblies 186 acts to extend and retract the first extension bracket 44. A second mechanism subassembly 187 (not visible in this view) acts to extend and retract the second extension bracket 45. First mechanism subassembly 186 is connected to a drive rod 188 which axially rotates during rotation of seat back 14 seat back reclining direction "F" from the upright to the seat back reclined position. As drive rod 188 rotates, a straight link 190 is directly rotated therewith. Straight link 190 is rotatably connected to a first transfer link 192, which in turn is rotatably connected to a second transfer link 194. A connecting arm 196 of second transfer link 194 is pinned to an extending end 198 of first extension bracket 44. A pin 200 connects a rotating member 202 to the first arm member 16 and allows the rotating member 202 to only rotate with respect to a longitudinal axis of pin 200. A pin 204 received in an elongated curved slot 206 of rotating member 202 guides rotation of rotating member 202. Displacement of second transfer link 194 and connecting arm 196 causes rotation of rotating member 202 and a general downward displacement of an extending end 208 of rotating member 202. The extending end 208 is pinned using a pin 210 to the first extension bracket 44 such that downward movement of extending end 208 causes a direct downward displacement of first extension bracket 44. When the seat back 14 is returned toward its upright position, drive rod 188 is oppositely axially rotated, thereby reversing the above motions and retracting the first extension bracket 44. Second mechanism subassembly 187 (partially shown in FIG. 6) is a mirror image of first mechanism subassembly 14, is connected to an opposite, left end of drive rod 188, and acts in the same manner to displace second extension bracket 45.

A furniture member leg rest mechanism 28 of the present disclosure includes a leg rest assembly 22 connected to a base frame 12 of a furniture member 10. The leg rest assembly 22 is extensible away from a stowed position (shown in FIGS. 1-2) by movement in a direction coincident with a lateral centerline 40 of the furniture member 10 to a fully extended and a center position of the leg rest assembly 22 (shown in FIGS. 3-7). A leg rest mechanism 28 connects the leg rest assembly 22 to the base frame 12. The leg rest mechanism 28 includes: an electric motor 94 acting when energized in a first mode (an extend command) to extend the leg rest assembly 22 away from the stowed position toward the fully extended position, and when energized in a second mode (a retract command) acting to return the leg rest assembly 22 from the fully extended to the stowed position. A detent assembly 112 has a central detent position 174 releasably retaining the leg rest assembly 22 at the fully extended center position. A pin 116 rotatably connects the leg rest assembly 22 to the leg rest mechanism 28 such that the leg rest assembly 22 when positioned in the fully extended and the center position is further manually rotatable with respect to a leg rest axis of rotation 58 defined by the pin 116 in at least one of a clockwise (direction of rotation "H") or a counterclockwise direction of rotation ("G") thereby creating a furniture member occupant egress space 72, 64 while the leg rest assembly 22 is positioned in the fully extended position.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member leg rest assembly, comprising:

a leg rest assembly connected to a base frame of a furniture member and extensible away from a stowed position by movement in a direction coincident with a lateral centerline of the furniture member to a fully extended and a center position of the leg rest assembly;

a pin rotatably connecting the leg rest assembly to the base frame such that the leg rest assembly when positioned in the fully extended and the center position is further manually rotatable with respect to a leg rest axis of rotation defined by the pin in at least one of a clockwise or a counterclockwise direction of rotation thereby creating a furniture member occupant egress space while the leg rest assembly is positioned in the fully extended position; and a leg rest mechanism connected to the furniture member base frame having the pin connected to a mechanism housing of the leg rest mechanism, the leg rest mechanism including a support foot downwardly extendable when the leg rest assembly is extended to the fully extended position and contacting a frame of the furniture member, the support foot acting to fix a rotated position of the base frame.

2. The furniture member leg rest assembly of claim 1, wherein the leg rest mechanism further includes an electric motor acting when energized to displace a leg drive tube, the leg rest assembly extensible by displacement of the leg rest drive tube.

3. The furniture member leg rest assembly of claim 1, wherein a rotation angle of the leg rest assembly about the leg rest axis of rotation is at least 30 degrees when the egress space is created.

4. The furniture member leg rest assembly of claim 1, wherein the at least one of the clockwise or the counterclockwise directions of rotation include both the clockwise and the counterclockwise directions of rotation.

5. A furniture member leg rest assembly comprising:

a leg rest assembly connected to a base frame of a furniture member and extensible away from a stowed position by movement in a direction coincident with a lateral centerline of the furniture member to a fully extended and a center position of the leg rest assembly;

a pin rotatably connecting the leg rest assembly to the base frame such that the leg rest assembly when positioned in the fully extended and the center position is further manually rotatable with respect to a leg rest axis of rotation defined by the pin in at least one of a clockwise or a counterclockwise direction of rotation thereby creating a furniture member occupant egress space while the leg rest is positioned in the fully extended position;

a leg rest mechanism connected to the furniture member base frame having the pin connected to a mechanism housing of the leg rest mechanism;

a seat back member rotatably connected to the base frame and rotatable between a fully upright and a fully reclined position independent of the leg rest assembly extension; and an extension bracket downwardly extended by the leg rest mechanism when the seat back member rotates to the fully reclined position, the extension bracket contacting a frame of the furniture member to fix a rotated position of the base frame at the fully reclined position of the seat back member.

6. The furniture member leg rest assembly of claim 5, wherein the leg rest mechanism includes a support foot downwardly extendable when the leg rest assembly is extended to the fully extended position and contacting a frame of the furniture member, the support foot acting to fix a rotated position of the base frame.

7. A furniture member leg rest assembly, comprising:

a leg rest mechanism connected to a furniture member base frame;

a leg rest mount board connected to the leg rest mechanism and extensible by actuation of the leg rest mechanism away from a stowed position by movement in a direction coincident with a lateral centerline of the furniture member to a fully extended and a center position of the leg rest mount board; and a pin rotatably connecting the leg rest mechanism to the base frame such that the leg rest mount board when positioned in the fully extended and the center position is further manually rotatable with respect to a leg rest axis of rotation defined by the pin in at least one of a clockwise or a counterclockwise direction of rotation creating a furniture member occupant egress space, wherein the leg rest mechanism includes a support foot downwardly extendable when the leg rest assembly is extended to the fully extended position and contacting a frame of the furniture member, the support foot acting to restrict rotation of the base frame relative to the frame.

8. The furniture member leg rest assembly of claim 7, wherein the leg rest mechanism further includes:

an electric motor connected to a drive housing; and a drive tube extensible from a drive tube support housing connected to the drive housing by operation of the electric motor.

9. The furniture member leg rest assembly of claim 8, wherein the leg rest mechanism further includes an engagement plate having the drive tube coupled to the engagement plate, the engagement plate rotated by extension of the drive tube.

10. The furniture member leg rest assembly of claim 7, wherein the leg rest mechanism further includes an engagement plate, the engagement plate rotated during extension of the leg rest mount board.

11. The furniture member leg rest assembly of claim 7, wherein the leg rest mechanism further includes a detent assembly having a central detent position acting to releasably retain the leg rest mount board at the fully extended and the center position.

12. The furniture member leg rest assembly of claim 11, wherein the detent assembly further includes a second detent position acting to releasably retain the leg rest mount board after rotation to create the egress space.

13. The furniture member leg rest assembly of claim 7, wherein the at least one of the clockwise or the counterclockwise directions of rotation include both the clockwise and the counterclockwise directions of rotation.

14. The furniture member leg rest assembly of claim 7, wherein a rotation angle of the leg rest mount board about the leg rest axis of rotation is at least 30 degrees.

15. The furniture member leg rest assembly of claim 7, wherein the furniture member occupant egress space is defined between a corner of the leg rest mount board and an arm member of the base frame.

16. A furniture member leg rest assembly, comprising:

a leg rest assembly connected to a base frame of a furniture member and extensible away from a stowed position by movement in a direction coincident with a lateral centerline of the furniture member to a fully extended and a center position of the leg rest assembly;

a leg rest mechanism connecting the leg rest assembly to the base frame, the leg rest mechanism including:

an electric motor acting when energized in a first mode to extend the leg rest assembly away from the stowed position toward the fully extended position, and when energized in a second mode acting to return the leg rest assembly from the fully extended to the stowed position;

a support foot downwardly extending as the leg rest assembly is extended to the fully extended position; and a detent assembly having a central detent position releasably retaining the leg rest assembly at the fully extended and the center position;

a pin rotatably connecting the leg rest assembly to the leg rest mechanism such that the leg rest assembly when positioned in the fully extended and the center position is further manually rotatable with respect to a leg rest axis of rotation defined by the pin in at least one of a clockwise or a counterclockwise direction of rotation thereby creating a furniture member occupant egress space while the leg rest assembly is positioned in the fully extended position; and a frame supporting the base frame on a floor surface, the support foot contacting the frame of the furniture member at the fully extended position of the leg rest assembly, the support foot acting to fix a rotated position of the base frame.

17. The furniture member leg rest assembly of claim 16, wherein the at least one of the clockwise or the counterclockwise directions of rotation include both the clockwise and the counterclockwise directions of rotation, creating each of a leg rest assembly counterclockwise rotated position and a leg rest assembly clockwise rotated position.

18. The furniture member leg rest assembly of claim 16, wherein the detent assembly further includes:

a disc having first, second and third semi-circular slots created in an outer perimeter of the disc; and a detent pin releasably received in one of the first, second or third slots of the disc individually releasably retaining the leg rest assembly at one of the center position, the leg rest assembly counterclockwise rotated position or the leg rest assembly clockwise rotated position.

19. A furniture member leg rest assembly comprising:

a leg rest assembly connected to a base frame of a furniture member and extensible away from a stowed position by movement in a direction coincident with a lateral centerline of the furniture member to a fully extended and a center position of the leg rest assembly;

a leg rest mechanism connecting the leg rest assembly to the base frame the leg rest mechanism including:

an electric motor acting when energized in a first mode to extend the leg rest assembly away from the stowed position toward the fully extended position, and when energized in a second mode acting to return the leg rest assembly from the fully extended to the stowed position; and a detent assembly having a central detent position releasably retaining the leg rest assembly at the fully extended and the center position;

a pin rotatably connecting the leg rest assembly to the leg rest mechanism such that the leg rest assembly when positioned in the fully extended and the center position is further manually rotatable with respect to a leg rest axis of rotation defined by the pin in at least one of a clockwise or a counterclockwise direction of rotation thereby creating a furniture member occupant egress space while the leg rest assembly is positioned in the fully extended position;

a frame supporting the base frame on a floor surface;

a seat back member rotatably connected to a drive rod; and an extension bracket connected by a mechanism subassembly to the drive rod, the extension bracket extended into contact with the frame during rotation of the drive rod as the seat back member rotates from a fully upright to a fully reclined position.

20. A furniture member leg rest assembly, comprising: a leg rest assembly connected to a base frame of a furniture member and extensible away from a stowed position to a fully extended position of the leg rest assembly;

a pin rotatably connecting the leg rest assembly to the base frame such that the leg rest assembly when positioned in the fully extended position is further manually rotatable with respect to a leg rest axis of rotation defined by the pin in a clockwise and a counterclockwise direction of rotation;

a seat back member rotatably connected to a drive member and the base frame and rotatable between a fully upright and a fully reclined position independent of the operation of the leg rest assembly; and an extension bracket connected by a mechanism subassembly to the drive member, the extension bracket extended into contact with the frame during rotation of the drive member as the seat back member rotates from a fully upright to a fully reclined position.

21. The furniture member leg rest assembly of claim 20, further comprising wherein rotation in either the clockwise or the counterclockwise direction of rotation creates a furniture member occupant egress space while the leg rest assembly is positioned in the fully extended position.

22. The furniture member leg rest assembly of claim 20, wherein the leg rest mechanism includes a support foot downwardly extendable when the leg rest assembly is extended to the fully extended position and contacting a frame of the furniture member, the support foot acting to restrict rotation of the base frame.

* * * * *